US005941929A

United States Patent [19]

Shiomi et al.

[11] Patent Number: 5,941,929

[45] Date of Patent: Aug. 24, 1999

[54] TRAFFIC CONTROL SERVICE ASSIST SYSTEM

[75] Inventors: Kakuichi Shiomi, Tokyo; Seiichiro Tanaka, Kawasaki; Yoichi Kusui, Fujisawa, all of Japan

[73] Assignees: Director-General, Ship Research Institue, Ministry of Trans, Tokyo; Kabushiki Kaisha Toshiba, Kawasaki, both of Japan

[21] Appl. No.: 08/828,365

[22] Filed: Mar. 28, 1997

[30] Foreign Application Priority Data

Mar. 29, 1996 [JP] Japan ..... 8-077454

[51] Int. Cl.[6] ..... G08G 5/00

[52] U.S. Cl. ..... 701/120; 342/36

[58] Field of Search ..... 701/120; 342/36; 340/989, 990

[56] References Cited

U.S. PATENT DOCUMENTS

| | | | |
|---|---|---|---|
| 4,706,198 | 11/1987 | Thurman | 364/439 |
| 5,200,902 | 4/1993 | Pilley | 364/439 |
| 5,557,278 | 9/1996 | Piccirillo et al. | 342/29 |
| 5,659,475 | 8/1997 | Brown | 364/439 |
| 5,732,384 | 3/1998 | Ellert et al. | 701/120 |
| 5,742,508 | 4/1998 | Kusui et al. | 364/439 |

*Primary Examiner*—Michael J. Zanelli

*Attorney, Agent, or Firm*—Oblon, Spivak McClelland, Maier & Neustadt, P.C.

[57] ABSTRACT

A plurality of control terminals are arranged to a plurality of control sections. Flight plan data of each control target aircraft is stored in a flight plan data management unit. The present positions of the control target aircraft are checked and acquired by an aircraft position information acquisition unit. The control states of the control target aircraft are managed by a control progress information management unit. The history of control of each control target aircraft is stored in a control progress information storage unit. A control target aircraft prediction unit predicts control target aircraft after a predetermined time on the basis of the control progress information and flight plan information. A control terminal assignment processing unit increases/decreases the number of control terminals on the basis of the prediction result and determines a control terminal for controlling control target aircraft. A data link transmission/reception unit forms a data link between the control target aircraft and the corresponding control terminal to assist transmission/reception of information. A control adjustment processing unit adjusts control progresses of the control terminals. With this arrangement, flexible traffic control can be performed in accordance with the traffic of control target aircraft.

8 Claims, 6 Drawing Sheets

TRAFFIC CONTROL SERVICE ASSIST SYSTEM

BACKGROUND OF THE INVENTION

The present invention relates to a traffic control service assist system for assisting traffic control in which controllers issue control instructions to pilots of aircraft in air traffic control in, e.g., an airfield.

A conventional control service for air traffic control is divided into some control sectors or service divisions. In accordance with flight progress strips printed on the basis of the flight plans of control target aircraft, a controller makes contact with pilots or persons concerned or confirmation using a radio or cable telephone while monitoring the positions of aircraft and vehicles visually or on a radar screen.

Generally, in an airfield, a plurality of controllers are assigned to the following sections. The control terminals of a traffic control assist system are allocated to the control consoles of these sections.

FD (Flight Data)

This controller receives IFR aircraft flight plans distributed from the airfield control tower, requests clearances to the control tower, and delivers clearances to the IFR departure controller. The controller also processes VFR aircraft flight plans provided by the flight information specialist, informs the flight information specialist of departure/arrival of aircraft, and assists the other controllers.

CD (Clearance Delivery)

The clearance delivery is advised of the departure sequence from aircraft waiting for departure, grasps spot numbers, and delivers clearances to aircraft.

GC (Ground Control)

The ground controller receives pushback and taxi requests from departing aircraft, decides the departure sequence, taxi route, and departure runway, and issues to aircraft a guidance to the runway. For arriving aircraft, the ground controller gives a guidance from the runway to spots.

LC (Local Control)

The local controller adjusts the departure control with the IFR departure controller upon being advised of ready-to-take-off from departing aircraft and issues a take-off clearance. This controller also issues a landing clearance (go-around instruction) to arriving aircraft and controls aircraft in the tower controlled airspace.

In the above control service, each controller manually handles flight progress strips, corrects plans using, e.g., a ball-point pen, and hands the flight progress strips to other controllers for transfer of control.

However, the traffic control service assist system assuming the conventional control method by manual strip management requires at least four monitor terminals for FD, CD, GC, and LC and the strip information is transferred among these terminals.

The conventional control method assuming a plurality of control sections and transfer of strip information among the control sections can be efficiently practiced in an airfield with a certain amount of traffic. However, this method is not necessarily efficient in an airfield having little traffic or in a time period with little traffic.

A traffic control service assist system in which the four control sections are partially consolidated may be used. However, control terminal processing for different services to be assigned to controllers must be individually developed. This complicates not only the operation method but also the system configuration.

The four-section control method can be efficiently practiced for an appropriate traffic. When the traffic increases, a plurality of controllers must be assigned to each section. This requires role assignment management for the plurality of controllers and also increases processing for information transfer.

As described above, the conventional traffic control service assist system assumes that each control area has an appropriate number of control targets because the controllers are assigned in accordance with the control areas. For this reason, a complex processing form for consolidating or dividing the sections according to the situation is required.

Additionally, the conventional operation including manual strip management by controllers often depend on the intelligence levels or flexibility of the controllers. If this operation is to be replaced with an assist apparatus, both the controllers and apparatus must be consolidated/allocated (divided). The man-machine interface and system configuration for switching between consolidation and division inevitably becomes complex.

BRIEF SUMMARY OF THE INVENTION

The present invention has been made to solve the above problems, and has as its object to provide a traffic control service assist system capable of flexibly coping with the number of control targets on the basis of the perfectly consolidated state of control sections, i.e., one control section for the minimum number of control targets.

In order to achieve the above object, according to the present invention, there is provided a traffic control service assist system comprising a plurality of control terminals arranged to control consoles to input/output control information, control target assignment means for identifying control targets, assigning the control targets to the plurality of control terminals, and providing operation information of the control targets, communication channel formation means for forming communication channels between the control targets and the control terminals assigned by the control target assignment means, position information providing means for acquiring position information of the control targets and providing the position information to the corresponding control terminals, and control progress situation providing means for determining control progress situation of all of the control targets on the basis of contents of communication between the control targets and the corresponding control terminals and providing information of the control progress situation of the control targets assigned to the control terminals, wherein one control terminal corresponds to at least one control target.

The control target assignment means predicts control targets after a predetermined time, collates a prediction result with present control target information, and increases/decreases the number of control terminals after the predetermined time in accordance with a collation result.

The control progress situation providing means has means for performing mutual situation determination on the basis of the control progress situation of all of the control targets and notifying the control terminals of a determination result to perform adjustment among the control terminals.

According to the present invention, there is also provided a traffic control service assist system for identifying control targets and assisting traffic control of controllers for the control targets, comprising a plurality of control terminals arranged to control sections to present control information and input/output data, an operation plan data management unit for storing data associated with operation plans filed in advance in units of the control targets, a control target position information acquisition unit for checking and acquiring present positions of the control targets, a control progress information management unit for managing control states of the control targets, a control progress information storage unit for storing histories of control of the control targets, a control target prediction unit for fetching the control progress information and operation plan information to predict control targets after a predetermined time, a control terminal assignment processing unit for increasing/decreasing the number of the control terminals on the basis of a prediction result from the prediction unit and determining a control terminal for controlling a control target, a data link transmission/reception unit for forming a data link between the control target and the assigned control terminal to assist transmission/reception of information, and a control adjustment processing unit for adjusting control progresses of the plurality of control terminals.

The control target prediction unit comprises the first procedure of acquiring the operation plan data from the operation plan data management unit to search for a target to be newly controlled at a present point, the second procedure of checking a presence of the new control target from information acquired by the control target position information acquisition unit, and the third procedure of, when the presence of the new control target is determined by the second procedure, notifying the control terminal assignment processing unit of the new control target at the present point which is obtained by the first procedure. Processing from the first procedure is repeated until control processing is ended.

The control target prediction unit comprises the fourth procedure of searching for a control target for which control is ended from present control targets in the control progress information storage unit, and the fifth procedure of, when it is determined by the fourth procedure that the control target for which control is ended is present, notifying the control terminal assignment processing unit of the control target for which control is ended. Processing from the fourth procedure is repeated until control processing is ended.

The control terminal assignment processing unit comprises the first procedure of determining presence/absence of notification of the presence of the new control target from the control target prediction unit, the second procedure of, when it is determined by the first procedure that notification of the new control target is present, determining presence/absence of control terminals in the plurality of control terminals, for which the number of control targets has not reached a maximum value, the third procedure of, when it is determined by the second procedure that the control terminals for which the number of control targets has not reached the maximum value are present, assigning the new control target to a control terminal having the smallest number of control targets, and the fourth procedure of, when it is determined by the second procedure that the control terminals for which the number of control terminals has not reached the maximum value is not present, increasing the number of control terminals and assigning the new control target. Processing from the first procedure is repeated until control processing is ended.

The control terminal assignment processing unit comprises the fifth procedure of determining presence/absence of notification of the presence of the control target for which control is ended from the control target prediction unit, the sixth procedure of, when it is determined by the fifth procedure that the control target for which control is ended is present, determining whether the number of control targets of a control terminal which has controlled the control target becomes zero, and the seventh procedure of, when it is determined by the sixth procedure that the number of control targets of the control terminal becomes zero, closing the control terminal. Processing from the fifth procedure is repeated until control processing is ended.

More specifically, the traffic control service assist system according to the present invention is a system for assisting traffic control of a controller for each control target on the basis of instruction information from the controller to the operator of the control target and request information from the operator of the control target to the controller. One or a plurality of control terminals are arranged in accordance with the number of control targets or traffic. The control terminals are assigned in correspondence with the control targets. With this arrangement, traffic control can be continued according to the same method without changing traffic control assignment such as consolidation or division of control consoles.

Particularly, a plurality of control terminals are arranged, and control targets are assigned to the control terminals. The state of each control target is displayed on the basis of request information from the operator of the control target to the controller, request information from the controller to the operator of the control target, the acquired state of the control target, and information from the control terminal.

The system has a function of monitoring the contents of an operation instruction from each control terminal to the corresponding control target on the basis of various acquired information and presenting/adjusting the instruction information of the priority or sequence of operations.

The system also has a function of automatically obtaining the position information of the control target and managing/adjusting the operation while displaying the state of the control target.

The system also has a function of presenting an instruction associated with the operation of each control target on the basis of various acquired information.

The system also has a function of displaying or transmitting information for increasing/decreasing the number of control sections or automatically increasing/decreasing the number of control sections on the basis of the number or states of control targets.

The system also has a function of aggregating the number of control targets and control situation in a predetermined period and determining an increase/decrease in the number of control terminals on the basis of the aggregated information.

In a control configuration having, e.g., two sections (consisting of two control terminals 1 and 2), the first target control is assigned to control section 1 (control terminal 1), and the next control target is assigned to control section 2 (control terminal 2). The third control target is normally assigned to control section 1 (control terminal 1), though it is assigned in accordance with the control progress situation.

More specifically, if the control target of control section 2 has already departed and is not controlled by control section 2 anymore, and the control target of control section 1 has not departed yet for some reason, the third control target can be assigned to control section 2 on the basis of, e.g., a policy of uniform load distribution.

The control sections are assigned in units of control targets. With this arrangement, the system has a function of determining the sequence or priority associated with the operation of each control target such as pushback, taxiing, take-off, or landing in the airfield and adjusting the control instructions to the control targets. Therefore, the conventional coordinator is not always required.

Particularly, since the positions and operation states of control targets are automatically or manually (semiautomatically) input to the control terminal, assignment of the control targets to the control sections (control terminals) and control instructions to the control targets can be mutually adjusted.

In addition, even when the number of control targets increases, and the work load on the controllers increases accordingly, assignment scheduling can be made to assign the subsequent control target to a reserved control terminal when extra control terminals are arranged. To the contrary, when the number of control targets decreases, assignment of one control terminal can be canceled. When the number of control targets becomes zero, assignment of the control terminal can be canceled.

If no control terminals are reserved, the number of control terminals can be increased to cope with an increase in the number of control targets, as a matter of course. In case of a decrease in the number of control targets as well, the number of control terminals can be decreased and moved to traffic control section with heavy traffic.

As described above, when the conventional control system that depends on manual operations of controllers shifts to the system using this traffic control service assist system, operation adjustment between control targets can be performed on the basis of control target information which is automatically or semiautomatically obtained. Without service transfer as in the prior art, control forms which are set in units of control targets can be easily managed and processed.

Especially, in an airport where traffic changes or in an airport originally having little traffic, not the conventional control system but the traffic control service assist form assuming the traffic control assist system applied in units of control targets is efficient. More specifically, the same system can be applied regardless of changes in traffic without complex operation switching or transfer. With this efficient, economical, and simple system form, a particularly great effect of the present invention can be obtained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will be described below with reference to FIGS. 1 to 6.

Figure 1:
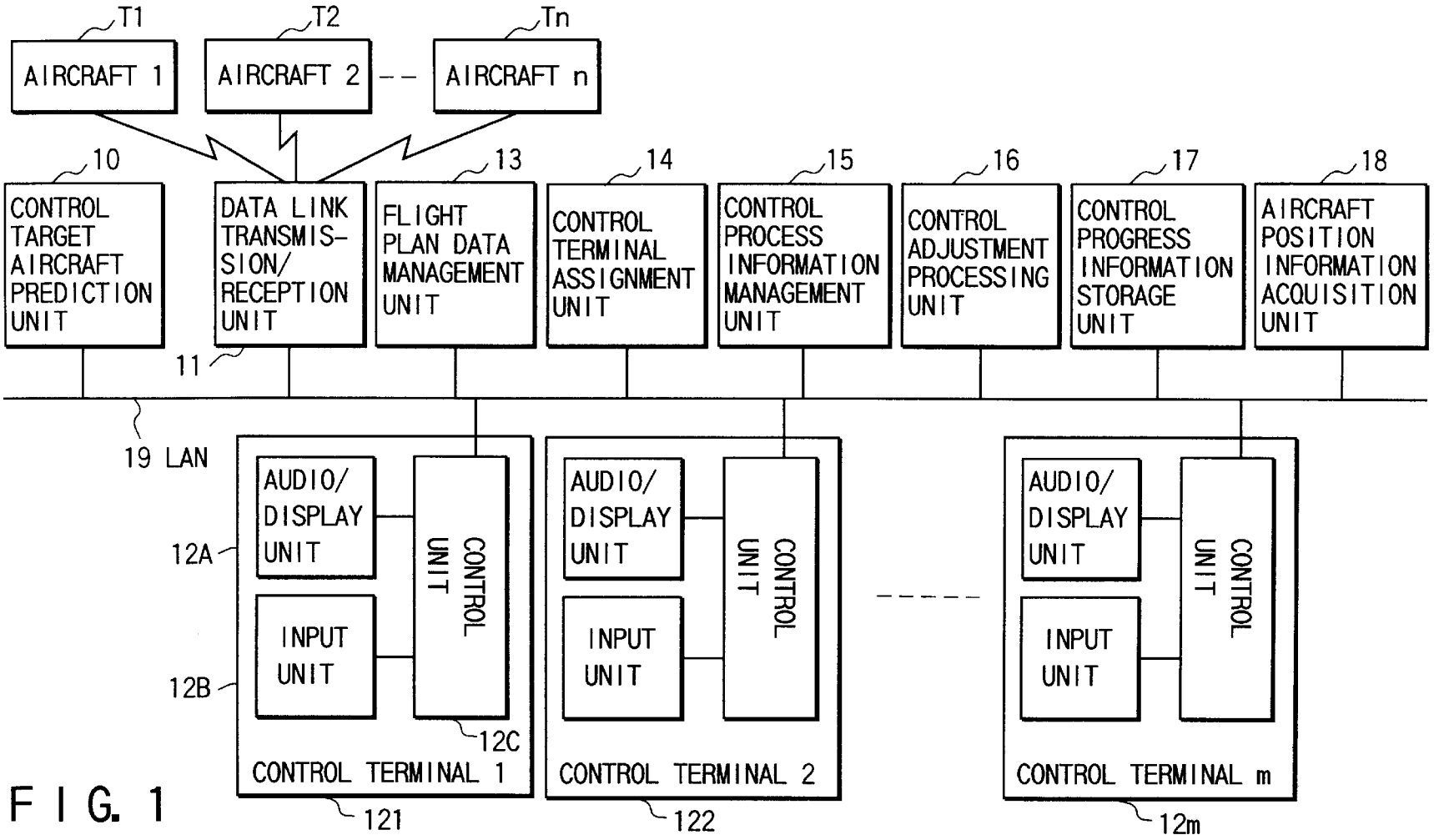
FIG. 1 is a block diagram showing the arrangement of a traffic control service assist system according to an embodiment of the present invention.

FIG. 1 is a block diagram showing the arrangement of a traffic control service assist system according to an embodiment of the present invention. This system comprises a control target aircraft prediction unit 10, a data link transmission/reception unit 11, m control terminals 121 to 12*m*, a flight plan data management unit 13, a control terminal assignment processing unit 14, a control progress information management unit 15, a control adjustment processing unit 16, a control progress information storage unit 17, and an aircraft position information acquisition unit 18. These units are connected to a LAN (Local Area Network) 19. The arrangements of the control terminals 121 to 12*m* are identical each of which comprises an audio/display unit 12A, an input unit 12B, and a control unit 12C.

The control target aircraft prediction unit 10 predicts aircraft (to be referred to as control target aircraft hereinafter) which are to be controlled after a predetermined time on the basis of control progress information and flight plans. The data link transmission/reception unit 11 forms a data link between each control target aircraft and a control terminal to which the aircraft is assigned, thereby assisting information transmission/reception.

The flight plan data management unit 13 stores data associated with a flight plan filed in advance for each aircraft. The control terminal assignment processing unit 14 increases/decreases the number of control terminals on the basis of the prediction result from the control target aircraft prediction unit 10 and determines the control terminal for controlling each control target aircraft. The control progress information management unit 15 manages the management state of each aircraft.

The control adjustment processing unit 16 adjusts control information among the control terminals 121 to 12*m*. The control progress information storage unit 17 stores the history of control of each control target aircraft. The aircraft position information acquisition unit 18 checks and acquires the present position of each control target aircraft.

The control terminals 121 to 12*m* control the assigned control target aircraft, respectively, and store control progress information about the control target aircraft in the control progress information storage unit 17 via the control progress information management unit 15.

In each of the control terminals 121 to 12*m*, the audio/display unit 12A presents information necessary for traffic control to a controller. The input unit 12B accepts the control data input operation of the controller. The control unit 12C controls information transmission/reception to/from the controller via the audio/display unit 12A and the input unit 12B.

In the above arrangement, the processing contents of each processing unit will be described below in detail.

The data link transmission/reception unit 11 performs communication with the aircraft. The flight plan data management unit 13 manages the flight plan of each aircraft which is filed in advance and notifies the contents of the flight plan when a unit inquires about them.

The control target aircraft prediction unit 10 predicts control target aircraft after a predetermined time on the basis of the control progress information and flight plans of present control target aircraft. The control terminal assignment processing unit 14 determines the number of control terminals after a predetermined time on the basis of the number of control target aircraft after the predetermined time which is predicted by the control target aircraft prediction unit 10 and the number of currently operating control terminals. When the number of control terminals need be increased/decreased, the number of control terminals is increased/decreased after the predetermined time has elapsed.

The control terminal assignment processing unit 14 assigns the new control target aircraft to one of the control terminals. In this assignment, information stored in the control progress information storage unit 17 is referred to determine the control progress situation of aircraft which are being managed by the control terminals 121 to 12*m*, and assigns the new aircraft to ones with the smallest load.

In each of the control terminals 121 to 12*m*, the audio/display unit 12A displays, on the screen, the positions of control target aircraft on a map, the flight plan data and control progress situation of the aircraft, and information of communication with the control target aircraft and outputs audio data, as needed.

The input unit 12B fetches control instruction information to the control target aircraft, which are input by the input operation of the controller. A mouse or touch panel is used as an input operation device.

The control unit 12C acquires the flight plan data, control progress information, and aircraft position information from the flight plan data management unit 13, the control progress information storage unit 17, and the aircraft position information acquisition unit 18, respectively, and displays these data on the audio/display unit 12A. The control unit 12C also transmits the control instruction information from the input unit 12B via the data link transmission/reception unit 11 and stores the information in the control progress information storage unit 17 as part of the control progress information.

Figure 2:
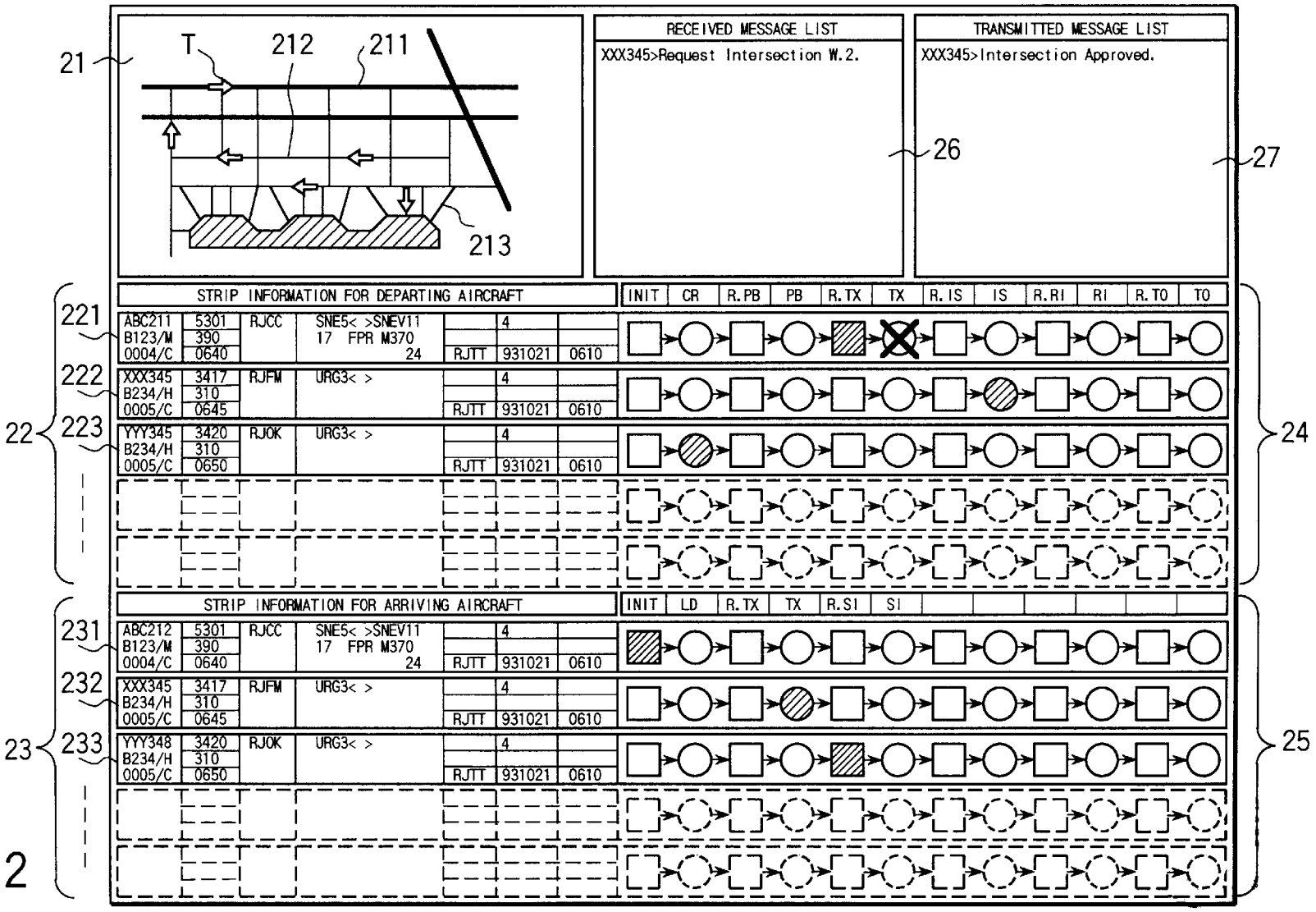
FIG. 2 is a view showing an example of a control terminal display screen of the embodiment.

FIG. 2 shows an example of a display screen of each of the control terminals 121 to 12*m*. Referring to FIG. 2, reference numeral 21 denotes an aircraft position display area 21 on the airport map; 22, a strip information display area for departing aircraft; 23, a strip information display area for arriving aircraft: 24, a control progress information display area for departing aircraft; 25, a control progress information display area for arriving aircraft; 26, a received message list display area; and 27, a transmitted message list display area.

In the aircraft position display area 21, all aircraft T and their directions are displayed in real time on a map in which a runway 211, a taxiway 212, a spot 213, and the like are drawn. The control target aircraft assigned to the control terminal can be more effectively displayed in a color different from that of the remaining aircraft assigned to other terminals.

When control target aircraft are assigned, strip information 221 to 223 and 231 to 233 of the control target aircraft pop up in the strip information display areas 22 and 23 for departing and arriving aircraft, respectively.

The aircraft call sign, type of aircraft, identification number, SSR information, secondary radar identification code, clearance limit, destination, altitude, FIX information, and the like are displayed as strip information.

In the control progress information display areas 24 and 25 for departing and arriving aircraft, corresponding item portions of control progress information items which are registered in advance are discriminated and displayed in units of strip information of the control target aircraft.

The control progress information includes the following items. For departing aircraft, the initial state (INIT), clearance (CR), request pushback (R-PB), pushback (PB), request taxiing (R-TX), taxiing (TX), request intersection (R-IS), intersection (IS), request into-position (R-IP), into position (IP), request take-off (R-TO), and take-off (TO) are sequentially arranged. For arriving aircraft, the initial state (INIT), landing (LD), request taxiing (R-TX), taxiing (TX), request spot-in, (R-SI), and spot in (SI) are sequentially arranged. This order of items is based on normal control contents.

Of these items, items representing a request from a pilot to the controller and items representing an instruction from the controller to the pilot are indicated by different figures. With this arrangement, these items can be easily discriminated by the controller. Items which are being executed are discriminated and displayed by a technique such as negative display.

The contents of requests (e.g., a voice message) from the control target aircraft to the controller and the contents of instructions (e.g., a voice message) from the controller to the pilots of the control target aircraft are displayed as character data on the received and transmitted message list display areas 26 and 27, respectively.

On the basis of the control information (present positions, control progress information, and control terminal assignment information) of the control target aircraft, the control adjustment processing unit 16 determines whether it is necessary to set the control sequence for the plurality of aircraft assigned to different control terminals. If the control sequence need be set, the associated control terminal is directed to set the sequence.

In the example of the display screen shown in FIG. 2, a mark x is displayed in accordance with an instruction from the control adjustment processing unit 16. In this example, a taxi request is received, and no taxi clearance can be issued.

The control progress information storage unit 17 determines the control progress situation on the basis of control instructions from the control terminals to the control target aircraft, control requests from the control target aircraft to the control terminals, and the positions of the control target aircraft, and stores the control progress information situation.

The aircraft position information acquisition unit 18 acquires position information of the aircraft from an apparatus such as a radar and informs the position of the aircraft when a unit inquires about it.

In the traffic control service assist system having the above arrangement, the processing operation of the control target aircraft prediction unit 10 will be described below with reference to FIGS. 3 and 4.

Figure 3:
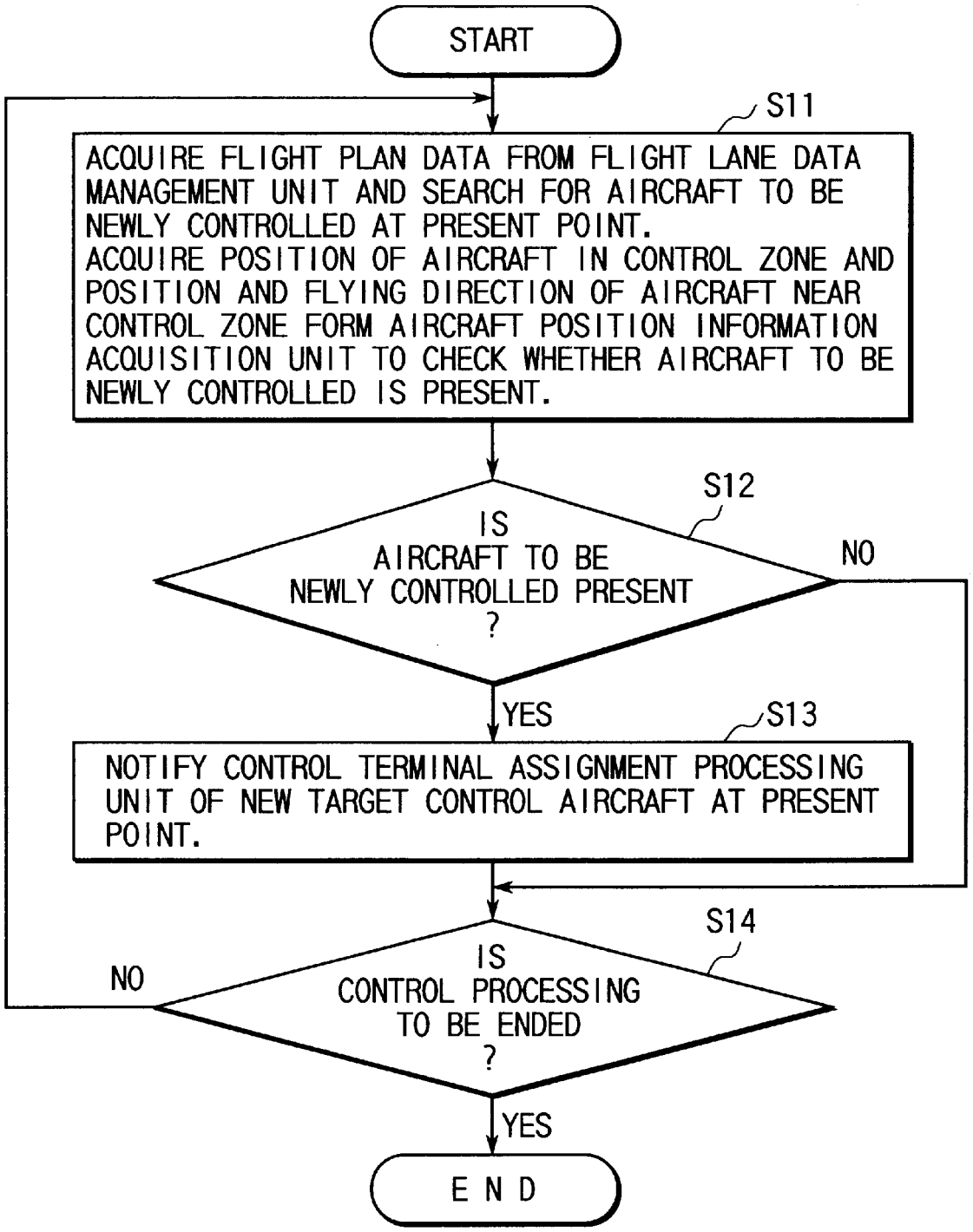
FIG. 3 is a flow chart for explaining the processing operation of a control target aircraft prediction unit of the embodiment.

As shown in FIG. 3, flight plan data are acquired from the flight plan data management unit 13 to search for aircraft which is to join control target aircrafts at the present point. The positions of aircraft in the control zone and the positions and flying directions of aircraft near the control zone are acquired from the aircraft position information acquisition unit 18 to check whether aircraft to be newly controlled is present (step S11).

It is determined whether aircraft to be newly controlled is present (step S12). If YES in step S12, the control terminal assignment processing unit 14 is notified of the aircraft to be newly controlled at the present point. After the notification, or if no aircraft to be newly controlled is present, it is determined whether control processing is to be ended (step S14). If NO in step S14, the flow returns to step S11. Otherwise, the processing waits for next processing.

Figure 4:
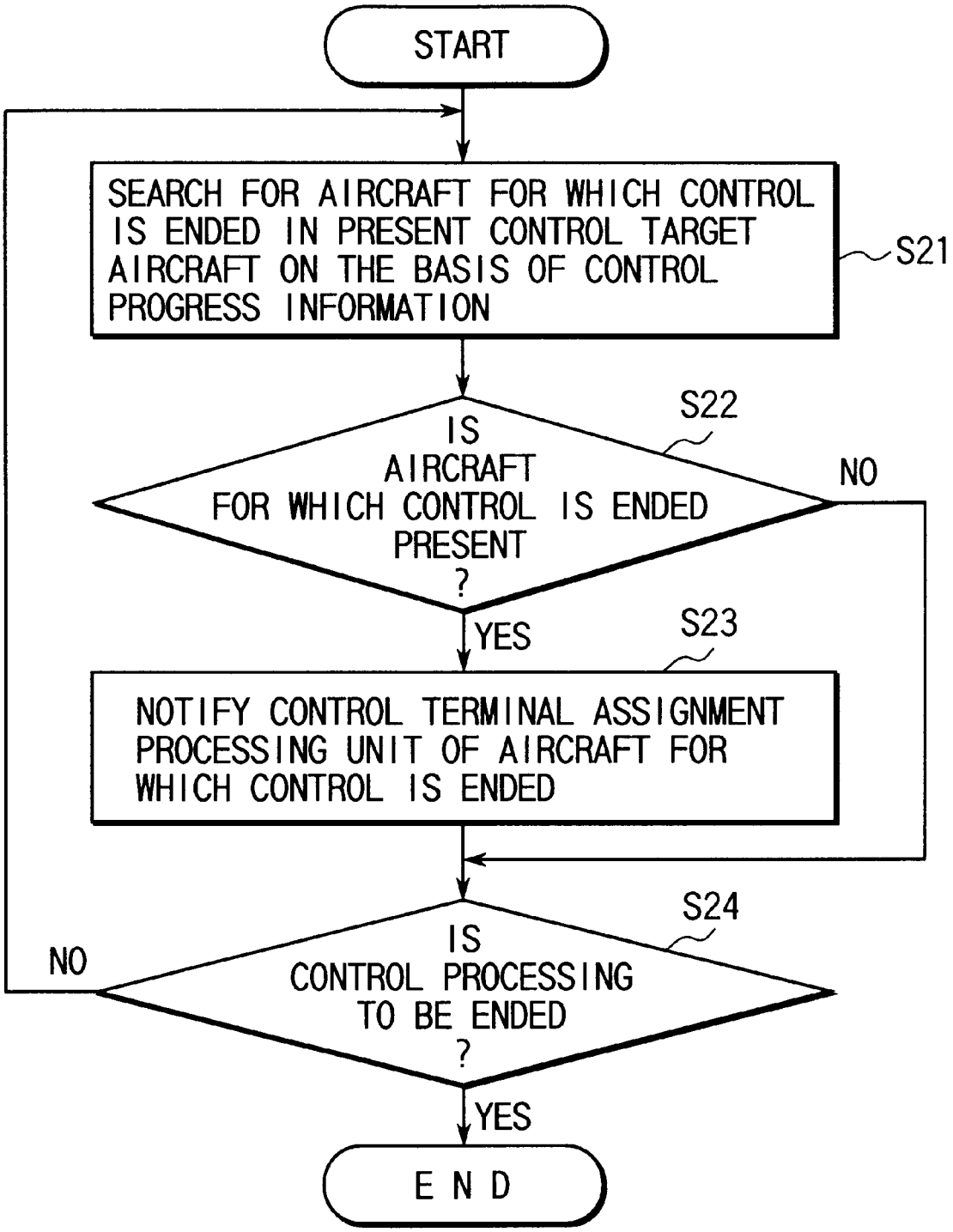
FIG. 4 is a flow chart for explaining the processing operation of the control target aircraft prediction unit of the embodiment.

As shown in FIG. 4, aircraft for which control is ended is searched for from the present control target aircraft in the control adjustment processing unit 16 (step S21). It is determined whether aircraft for which control is ended is present (step S22). If YES in step S22, the control terminal assignment processing unit 14 is notified of the aircraft for which control is ended (step S23). After this notification, or if NO in step S22, it is determined whether control processing is to be ended (step S24). If NO in step S24, the flow returns to step S21. Otherwise, the processing waits for next processing.

The processing operation of the control terminal assignment processing unit 14 will be described below with reference to FIGS. 5 and 6.

Figure 5:
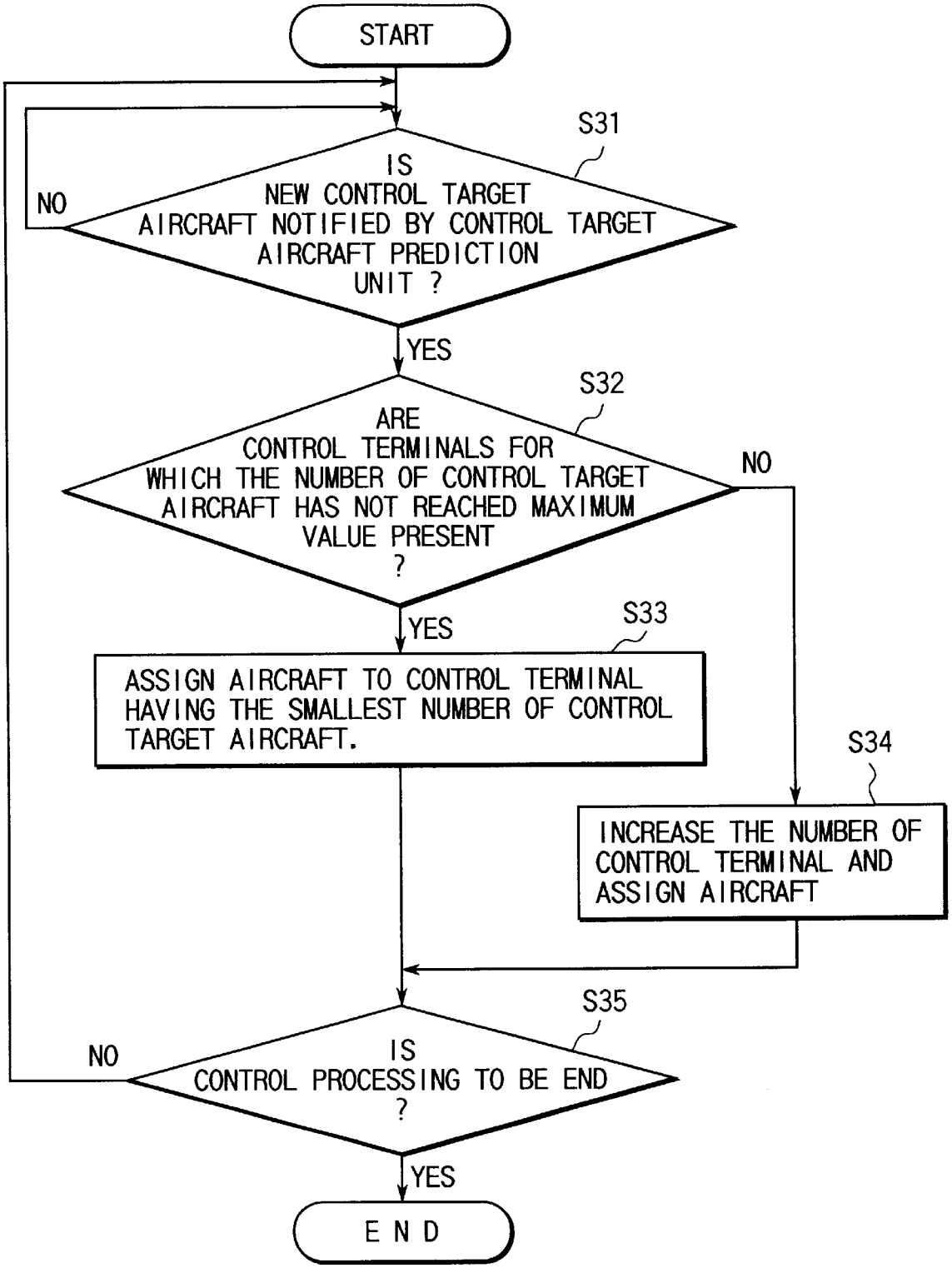
FIG. 5 is a flow chart for explaining the processing operation of a control terminal assignment processing unit of the embodiment.

As shown in FIG. 5, the processing waits until aircraft to be newly controlled is informed by the control target aircraft prediction unit 10 (step S31). If YES in step S31, it is determined whether any control terminals where the number of control target aircraft does not reach the maximum value are present (step S32).

If YES in step S32, the aircraft is assigned to a control terminal which is controlling the smallest number of control target aircraft (step S33). Otherwise, the number of control terminals is increased to assign the aircraft to a new control terminal. After the assignment processing, it is determined whether control processing is to be ended (step S34). If NO in step S31, the flow returns to step S31. Otherwise, the processing waits for next processing.

Figure 6:
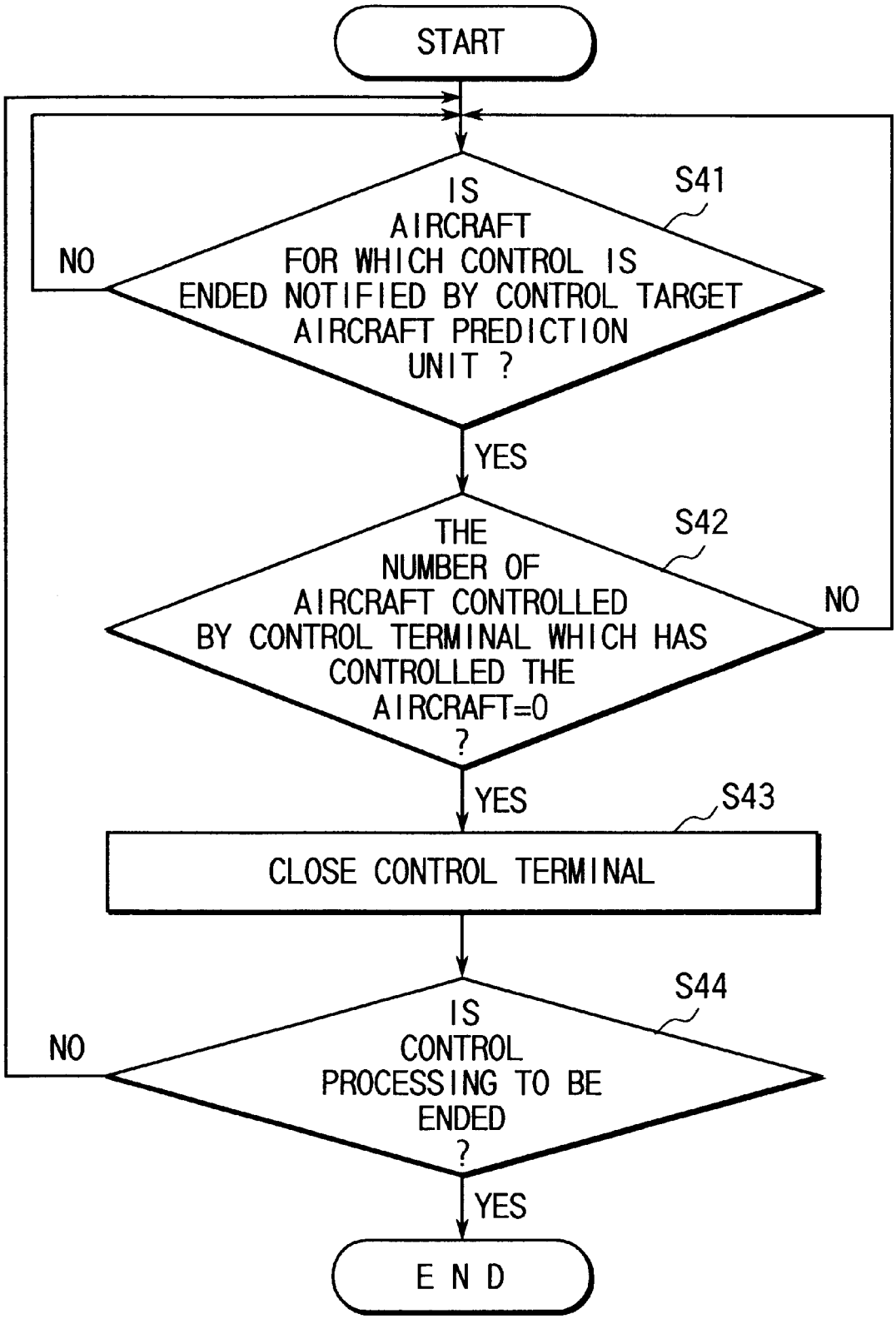
FIG. 6 is a flow chart for explaining the processing operation of the control terminal assignment processing unit of the embodiment.

As shown in FIG. 6, the processing waits until aircraft for which control is ended is informed by the control target aircraft prediction unit 10 (step S41). It is determined whether the number of air traffic controlled by the control terminal which has controlled the aircraft becomes zero (step S42). The processing in steps S41 and 42 is repeated until the number of aircraft becomes zero. If YES in step S42, the control terminal is closed (step S43), and it is determined whether control processing is to be ended (step S44). If NO in step S44, the flow returns to step S41. Otherwise, the processing waits for next processing.

According to the above system configuration, in a control configuration having, e.g., two sections (consisting of two control terminals), the first control target aircraft is assigned to control section 1 (control terminal 1), and the next aircraft is assigned to control section 2 (control terminal 2). The third aircraft is normally assigned to control section 1 (control terminal 1), though it is assigned in accordance with the control progress situation.

More specifically, if the aircraft of control section 2 has already departed and is not controlled by control section 2 anymore, and the aircraft of control section 1 has not departed yet for some reason, the third aircraft can be assigned to control section 2 on the basis of, e.g., a policy of uniform load distribution.

The control sections (control terminals) are assigned in units of aircraft. With this arrangement, the system has a function of determining the sequence or priority associated with the operation of each aircraft such as pushback, taxiing, take-off, or landing in the airfield and adjusting the control instruction to the aircraft. Therefore, the conventional coordinator is not always required.

Particularly, since the positions and operation states of aircraft are automatically or manually (semiautomatically) input to the control terminal, assignment of the aircraft to the control sections (control terminals) and control instructions to the aircraft can be mutually adjusted.

In addition, even when the number of control target aircraft increases, and the work load on controllers increases accordingly, scheduling can be made to assign the subsequent aircraft to a reserved control terminal because extra control terminals are arranged. To the contrary, when the number of control target aircraft decreases, assignment of one control terminal can be canceled. When the number of control target aircraft becomes zero, assignment of the control terminal can be canceled.

If no control terminals are reserved, the number of control terminals can be increased to cope with an increase in traffic, as a matter of course. In case of a decrease in traffic as well, the number of control terminals can be decreased and moved to traffic control section with heavy traffic.

As described above, when the conventional control system that depends on the manual operation of controllers shifts to the system using the traffic control assist system of the present invention, operation adjustment between aircraft can be performed on the basis of aircraft information which is automatically or semiautomatically obtained. Since control forms can be set in units of aircraft, service transfer as in the prior art becomes unnecessary. Therefore, management or processing is facilitated.

Especially, in an airport where traffic changes or in an airport originally having little traffic, not the conventional control system but the traffic control assist form assuming the traffic control assist system applied in units of aircraft is efficient. More specifically, the same system can be applied regardless of changes in traffic without complex operation switching or transfer. With this efficient, economical, and simple system form, the present invention provides a marked effect.

In the above embodiment, only aircraft have been described as control targets. Actually, vehicles in the airport are also controlled. In this case as well, when a vehicle is handled as a control target, traffic control assistance can be similarly given, as a matter of course.

As has been described above, according to the present invention, a traffic control service assist system which increases/decreases the number of control terminals in accordance with the air traffic, assuming that the control system for assigning traffic control in units of aircraft is employed on the basis of the perfectly consolidated state of control sections, i.e., one control section for the minimum number of control target aircraft can be provided.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A traffic control service assist system comprising:

a plurality of control terminals arranged to control consoles to input/output control information;

control target assignment means for identifying control targets, assigning said control targets to said plurality of control terminals, and providing operation information of said control targets;

communication channel formation means for forming communication channels between said control targets and said control terminals assigned by said control target assignment means;

position information providing means for acquiring position information of said control targets and providing the position information to said corresponding control terminals; and control progress situation providing means for determining control progress situation of all of said control targets on the basis of contents of communication between said control targets and said corresponding control terminals and providing information of the control progress situation of said control targets assigned to said control terminals, wherein one control terminal corresponds to at least one control target.

2. A system according to claim 1, wherein said control target assignment means predicts control targets after a predetermined time, collates a prediction result with present control target information, and increases/decreases the number of control terminals after the predetermined time in accordance with a collation result.

3. A system according to claim 1, wherein said control progress situation providing means has means for performing mutual situation determination on the basis of the control progress situation of all of said control targets and notifying said control terminals of a determination result to perform adjustment among said control terminals.

4. A traffic control service assist system for identifying control targets and assisting traffic control of controllers for said control targets, comprising:

a plurality of control terminals arranged to control sections to present control information and input/output data;

an operation plan data management unit for storing data associated with operation plans filed in advance in units of said control targets;

a control target position information acquisition unit for checking and acquiring present positions of said control targets;

a control progress information management unit for managing control states of said control targets;

a control progress information storage unit for storing histories of control of said control targets;

a control target prediction unit for fetching the control progress information and operation plan information to predict control targets after a predetermined time;

a control terminal assignment processing unit for increasing/decreasing the number of said control terminals on the basis of a prediction result from said prediction unit and determining a control terminal for controlling a control target;

a data link transmission/reception unit for forming a data link between said control target and the assigned control terminal to assist transmission/reception of information; and a control adjustment processing unit for adjusting control progresses of said plurality of control terminals.

5. A system according to claim 4, wherein said control target prediction unit comprises:

first means for acquiring the operation plan data from said operation plan data management unit to search for a target to be newly controlled at a present point;

second means for checking a presence of the new control target for information acquired by said control target position information acquisition unit; and third means, when the presence of the new control target is determined by the second means, for notifying said control terminal assignment processing unit of the new control target at the present point which is obtained by the first means, and wherein said first, second and third means repeat said acquiring, checking, and notifying, respectively until control processing is ended.

6. A system according to claim 4, wherein said control target prediction unit comprises:

first means for searching for a control target for which control is ended from present control targets in said control progress information storage unit; and second means, when it is determined by the first means that said control target for which control is ended is present, for notifying said control terminal assignment processing unit of said control target for which control is ended, and wherein said first means and said second means repeat said searching and said notifying, respectively, until control processing is ended.

7. A system according to claim 5, wherein said control terminal assignment processing unit comprises:

fourth means for determining presence/absence of notification of the presence of the new control target from said control target prediction unit;

fifth means, when it is determined by the fourth means that notification of the new control target is present, for determining presence/absence of control terminals in said plurality of control terminals, for which the number of control targets has not reached a maximum value;

sixth means, when it is determined by the fifth means that said control terminals for which the number of control targets has not reached the maximum value are present, for assigning the new control target to a control terminal having the smallest number of control targets; and seventh means, when it is determined by the fifth means that said control terminals for which the number of control terminals has not reached the maximum value is not present, for increasing the number of control terminals and assigning the new control target, and wherein said fourth, fifth, sixth and seventh means repeat their respective processing functions until control processing is ended.

8. A system according to claim 6, wherein said control terminal assignment processing unit comprises:

third means for determining presence/absence of notification of the presence of said control target for which control is ended from said control target prediction unit;

fourth means, when it is determined by the third means that said control target for which control is ended is present, for determining whether the number of control targets of a control terminal which has controlled said control target becomes zero; and fifth means, when it is determined by the fourth means that the number of control targets of said control terminal becomes zero, closing said control terminal; and wherein said third, fourth and fifth means repeat their respective processing functions until control processing is ended.

* * * * *

UNITED STATES PATENT AND TRADEMARK OFFICE

CERTIFICATE OF CORRECTION

PATENT NO. : 5,941,929

DATED : August 24, 1999

INVENTOR(S): Kakuichi SHIOMI, et al.

It is certified that an error appears in the above-identified patent and that said Letters Patent is hereby corrected as shown below:

On the title page, item [73], the first assignee's name should be:

--Director-General, Ship Research Institute, Ministry of Trans--

Signed and Sealed this

Thirtieth Day of May, 2000

*Attest:*

Q. TODD DICKINSON

*Attesting Officer*

*Director of Patents and Trademarks*